United States Patent [19]

Huang

[11] Patent Number: 4,496,615

Date of Patent: Jan. 29, 1985

[54] COLLAPSIBLE PLASTIC TREE

[76] Inventor: Herbert P. H. Huang, No. 1, Hsin-Hsing St., Shu Lin, Taipei Hsien, Taiwan

[21] Appl. No.: 550,132

[22] Filed: Nov. 9, 1983

[51] Int. Cl.[3] ..... A47G 33/06

[52] U.S. Cl. ..... 428/9; 211/196; 211/205; 428/20

[58] Field of Search ..... 428/18, 19, 20, 8, 9–12; 156/61; 362/123; D11/118; 211/196, 197, 205

[56] References Cited

U.S. PATENT DOCUMENTS 2,826,846 3/1958 Warren ..... 428/20 X 3,928,689 12/1975 Mottel ..... 428/20 X

*Primary Examiner*—Henry F. Epstein

*Attorney, Agent, or Firm*—Lowe, King, Price & Becker

[57] ABSTRACT

The present invention relates to an improved collapsible plastic tree and in particular to one comprising a plastic trunk having a plurality of holes, a plurality of collars disposed on the plastic trunk, a plurality of ribs movably mounted on the collars, and a plurality of plastic branches each firmly joined to one of the ribs. The plastic branches will lay open with respect to the plastic trunk when the plastic trunk is vertically disposed and the plastic branches will be folded up on the plastic trunk when the plastic trunk is disposed upside down.

2 Claims, 3 Drawing Figures

COLLAPSIBLE PLASTIC TREE

BACKGROUND OF THE INVENTION

It is found that the plastic decoration tree such as the plastic Christmas tree available on the market may be dismantled into a trunk and a number of branches. However, the trunk and branches of such plastic decoration tree are joined together by insertion engagement so that the junction connecting the trunk to the branches will often be damage after being used for a long time. Furthermore, it takes a long time to assemble such a plastic decoration tree.

It is, therefore, an object of the present invention to provide an improved plastic tree which may obviate and mitigate the drawbacks sufferred by the known plastic trees.

SUMMARY OF THE INVENTION

It is a primary object of the present invention to provide an improved collapsible plastic tree which may be folded when not in use.

It is another object of the present invention to provide an improved collapsible plastic tree which is easily operated.

It is still another object of the present invention to provide an improved collapsible plastic tree which is easy to fabricate.

It is a further object of the present invention to provide an improved collapsible plastic tree which is easy to assemble.

It is still a further object of the present invention to provide an improved collapsible plastic tree which is economic to produce.

Other objects and merits and a fuller understanding of the present invention will be obtained by those skilled in the art when the following detailed description of the best mode contemplated for practicing the invention is read in conjunction with the accompanying drawings wherein like numerals refer to like or similar parts and in which:

DETAILED DESCRIPTION OF THE PREFERRED EMBODIMENT

Figure 1:
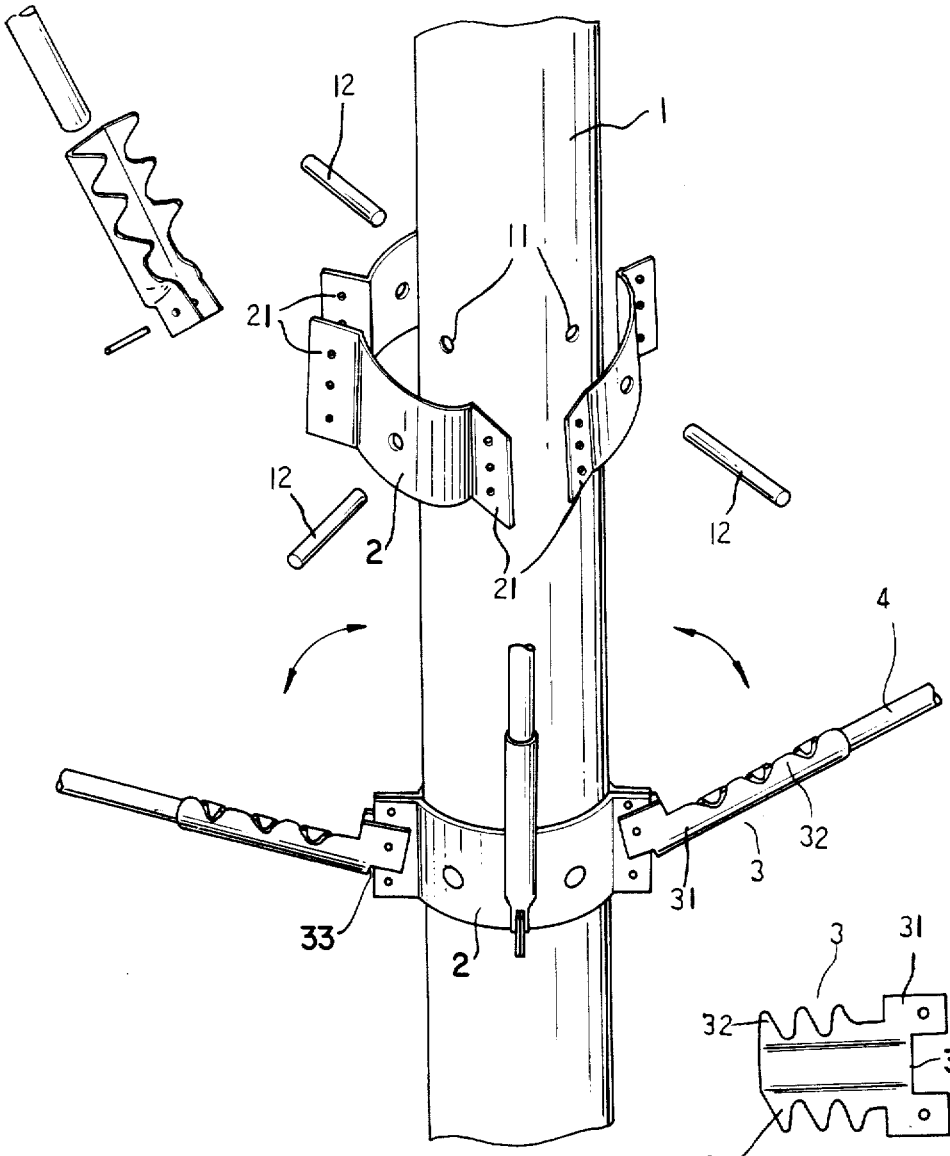
FIG. 1 is a partial fragmentary perspective view of an improved collapsible plastic tree according to the present invention.
Figure 2:
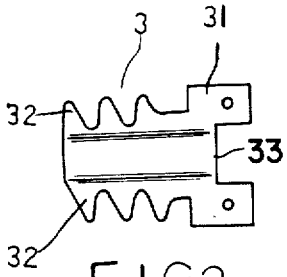
FIG. 2 is a developed view of a joint of the collapsible plastic tree.

Turning to FIG. 1, the collapsible plastic tree according to the present invention comprises a trunk (1) which is preferably made of plastic. The plastic trunk (1) is provided with a plurality of holes (11). A number of curved plates (2) are fixed on the plastic trunk (1) by engaging plastic rivets (12) into the holes (11) of the plastic trunk (1). Each of the curved plates (2) is provided with two flat portions (21) each riveted on a flat portion (21) of another curved plates (2). Further, the flat portions (21) of any two adjacent curved plates (2) are joined together by means of rivets so as to form a collar. On the junction of any two adjacent curved plates (2) is pivoted a rib (3) which is formed of a sheet metal. With reference to FIG. 2, there is shown a developed view of a rib (3). To manufacture a rib (3), first stamp out a sheet metal as shown in FIG. 2 and then bend the sheet metal into a rib (3) as shown in FIG. 1. As may be seen in FIG. 1, the rib (3) comes with a U-shaped portion (31) at one end and a serrated portion (32) at the other end. The U-shaped portion (31) of the rib (3) is pivoted on the junction of two adjacent curved plates (2), while the serrated porton (32) of the rib (3) is rolled up to tightly wrap around the lower end of a plastic branch (4) so as to fix the plastic branch (4) to the serrated portion (32) of the rib (3). The U-shaped portion (31) of the rib (3) is formed with an edge (33) designed to limit outward extent of the rib (3).

When the improved collapsible plastic tree according to the present invention is disposed vertically, the branches (4) attached to the ribs (3) will swing to their outstretched, upswept positions with respect to the plastic trunk (1) by virtue of gravity, thereby resulting in the shape of a tree.

Figure 3:
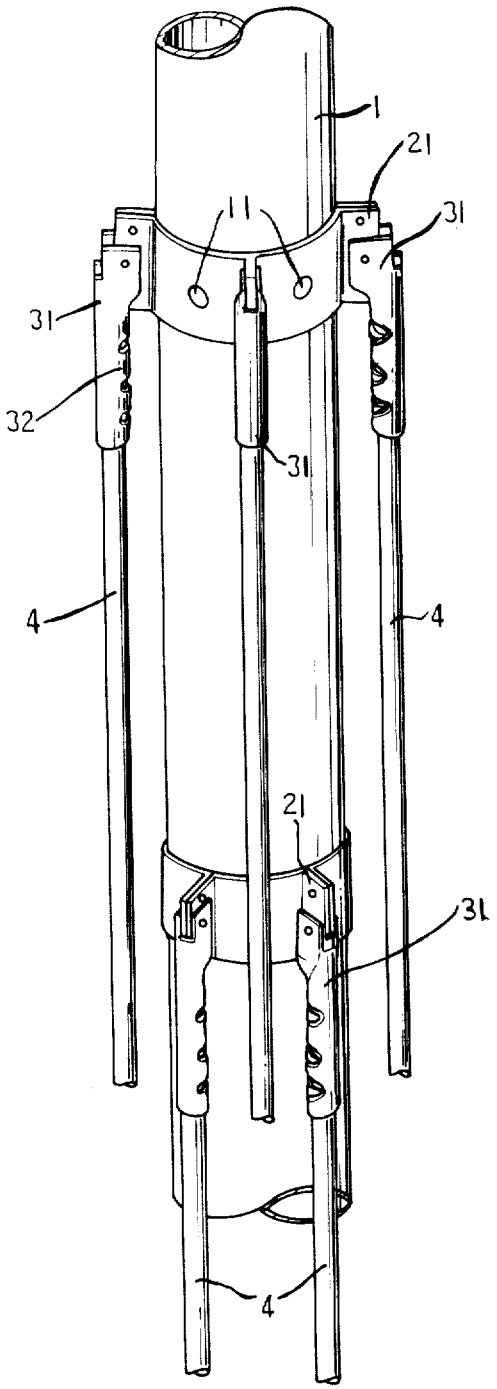
FIG. 3 is a perspective view showing the collapsible plastic tree put upside down.

With reference to FIG. 3, as the improved collapsible plastic tree is disposed upside down, the branches (4) will fall downward, thereby collapsing the plastic tree. Accordingly, it is of no difficulty to open and close the collapsible tree. Furthermore, the present invention occupies little space when not in use, thus facilitating the storing, transportation and packaging of the plastic tree.

Although this invention has been described with a certain degree of particularity, it is understood that the present disclosure has been made by way of example only and that numerous changes in the detail of construction and the arrangement and combination of parts may be resorted to without departing from the spirit and scope of the invention as hereinafter claimed.

I claim:

1. An improved collapsible plastic tree comprising:

a plastic trunk in the form of a cylindrical tube;

a plurality of collars each having a number of curved plates mounted to said trunk, each of said curved plates being formed with two flat portions each joined to a flat portion of another one of said curved plates to form a junction;

a plurality of ribs, each formed at one end with a serrated portion and at the other end with a U-shaped portion having an edge designed to limit the outward extent of the rib, said U-shaped portion being pivoted on the junction of two of said curved plates in such a way that said rib will swing to its outstretched, upswept position when said plastic trunk is vertically disposed and will collapse when said plastic trunk is inverted; and a plurality of plastic branches, each tightly wrapped in the serrated portion of each said rib.

2. The plastic tree of claim 1, wherein said collars are mounted to said trunk with rivets and wherein the flat portions of curved plates are joined to each other with rivets.

* * * * *